US010151199B2

(12) United States Patent
Kuiper

(10) Patent No.: US 10,151,199 B2
(45) Date of Patent: Dec. 11, 2018

(54) AUTOMATIC DUST SUPPRESSION SYSTEM AND METHOD

(71) Applicant: Harnischfeger Technologies, Inc., Wilmington, DE (US)

(72) Inventor: Eric J. Kuiper, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 555 days.

(21) Appl. No.: 14/825,205

(22) Filed: Aug. 13, 2015

(65) Prior Publication Data

US 2016/0047241 A1 Feb. 18, 2016

Related U.S. Application Data

(60) Provisional application No. 62/037,081, filed on Aug. 13, 2014.

(51) Int. Cl.

| | |
|---|---|
| ***E21B 21/015*** | (2006.01) |
| ***E21B 21/07*** | (2006.01) |
| ***E21C 35/04*** | (2006.01) |
| ***E21C 35/22*** | (2006.01) |
| ***E21C 35/23*** | (2006.01) |
| ***E21F 5/02*** | (2006.01) |

(52) U.S. Cl.

CPC ..... *E21C 35/04* (2013.01); *E21B 21/015* (2013.01); *E21B 21/07* (2013.01); *E21C 35/223* (2013.01); *E21C 35/23* (2013.01); *E21F 5/02* (2013.01)

(58) Field of Classification Search

CPC ..... E21B 21/015; E21B 21/07; E21C 7/00; E21C 7/04; E21C 7/08; E21C 4/10; E21C 7/12; E21C 35/22; E21C 35/223

See application file for complete search history.

(56) References Cited

U.S. PATENT DOCUMENTS

| | | | |
|---|---|---|---|
| 3,070,180 | A | 12/1962 | Norrick |
| 3,910,360 | A | 10/1975 | Sundstrom |
| 4,384,874 | A | 5/1983 | Dattilo |
| 4,434,861 | A | 3/1984 | Howeth |
| 4,465,318 | A | 8/1984 | Lewis et al. |
| 4,552,487 | A | 11/1985 | Weirich |
| 4,646,853 | A | 3/1987 | Sugden et al. |
| 4,793,421 | A | 12/1988 | Jasinski |

(Continued)

FOREIGN PATENT DOCUMENTS

| | | |
|---|---|---|
| CN | 101915116 A | 12/2010 |
| CN | 202991046 | 6/2013 |

(Continued)

OTHER PUBLICATIONS

Translation of Chinese Patent CN103422881 published Dec. 4, 2013 (Year: 2013).*

(Continued)

*Primary Examiner* — Giovanna C. Wright

(74) *Attorney, Agent, or Firm* — Michael Best & Friedrich LLP

(57) ABSTRACT

Systems and methods for controlling dust. One method includes automatically detecting an operating status of a mining machine. The method also includes automatically, with an electronic processor, adjusting operation of a dust suppression system based on the operating status of the mining machine.

26 Claims, 6 Drawing Sheets

(56) References Cited

U.S. PATENT DOCUMENTS

| | | | | |
|---|---|---|---|---|
| 5,268,683 | A * | 12/1993 | Stolarczyk | E21C 35/24 175/40 |
| 5,844,133 | A * | 12/1998 | Goto | E21B 44/00 175/24 |
| 6,162,284 | A | 12/2000 | Mitchell et al. | |
| 6,216,800 | B1 | 4/2001 | Wilson et al. | |
| 6,578,646 | B2 | 6/2003 | Juujarvi et al. | |
| 7,798,247 | B2 * | 9/2010 | Julkunen | E21C 35/223 175/57 |
| 7,987,929 | B2 | 8/2011 | Sormunen | |
| 8,152,905 | B2 | 4/2012 | Tuomas | |
| 2003/0024740 | A1 * | 2/2003 | Juujarvi | E21B 21/07 175/66 |
| 2004/0216608 | A1 | 11/2004 | Small | |
| 2007/0125558 | A1 * | 6/2007 | Embry | A01B 79/00 172/66 |
| 2010/0215449 | A1 * | 8/2010 | Kern | B23B 39/14 408/1 R |
| 2011/0255994 | A1 * | 10/2011 | Field | F04B 49/022 417/53 |
| 2012/0255775 | A1 | 10/2012 | Stacy, II et al. | |
| 2017/0226808 | A1 * | 8/2017 | Vandapel | E21B 12/06 |

FOREIGN PATENT DOCUMENTS

| | | | |
|---|---|---|---|
| CN | 202991046 | U | 6/2013 |
| CN | 103422881 | A * | 12/2013 |
| CN | 103696797 | A | 4/2014 |
| CN | 103711513 | A | 4/2014 |
| WO | 2010029216 | | 3/2010 |
| WO | 2011109024 | | 9/2011 |
| WO | 2012142446 | | 10/2012 |
| WO | 2014019101 | | 2/2014 |

OTHER PUBLICATIONS

Chilean Examiner's Report for Application No. 201502269 dated Sep. 12, 2017 (9 pages including Statement of Relevance).

Office Action from the Chinese Patent Office for related Application No. 2015104968.2 dated May 18, 2018 (8 pages including Statement of Relevance).

* cited by examiner

AUTOMATIC DUST SUPPRESSION SYSTEM AND METHOD

RELATED APPLICATION

This application claims the benefit of U.S. Provisional Application No. 62/037,081 filed on Aug. 13, 2014, the entire contents of which are incorporated by reference herein.

BACKGROUND

Embodiments of the invention relate to automatic dust suppression for machinery, such as a blasthole drill or other mining machinery.

SUMMARY

Mining machinery, such as a blasthole drill, often produces excessive amounts of dust due to the type of material being drilled as well as other environmental factors commonly found in mining sites. Excessive amounts of dust can prevent an operator from adequately viewing the operation of the drill. Furthermore, excessive dust can reduce visibility in the surrounding area thereby creating a hazard for operators of other nearby equipment. In some situations, dust control is heavily regulated due to the proximity of the mining site to populated areas.

Dust suppression systems and methods, such as water injection (i.e., pumping water through the center of a drill steel to jets in a drill bit) and/or dry dust collection (i.e., using a fan to create a vacuum around the drilling area, collecting the dust, and periodically dumping the collected dust in a controlled manner) can reduce the amount of dust produced during drilling. However, these systems and methods are often controlled manually, which is impractical when mining machinery is remotely or autonomously controlled. Furthermore, a common approach to address excessive dust is to manually set the water injection flow rate and/or the vacuum suction at a maximum level (e.g., maximum water flow level and maximum suction level). This approach often consumes more energy and water than necessary to suppress dust in a given situation or environment. For example, for machinery using water injection, the onboard water supply diminishes more quickly when these maximum levels are used, which requires numerous water refills delaying operation.

Accordingly, embodiments of the invention provide systems and methods for detecting dust and airborne particles (hereinafter referred to as "dust") and/or machine operating statuses and automatically suppressing the dust using water injection and/or dry dust collection based on the detected data. The systems and methods improve operator visibility. Furthermore, by using only the amount of water or suction power needed to control the amount of dust currently being produced, the systems and methods reduce energy and water consumption.

One embodiment of the invention provides a system for suppressing dust. The system includes a water injection dust suppression system, a dry dust collection system, a particulate sensor, a hole depth sensor, and a controller. The controller is configured to receive a first value from the particulate sensor, receive a second value from the hole depth sensor, and adjust at least one selected from the grouping consisting of a water flow level of the water injection dust suppression system and a suction level of the dry dust collection system based on at least one selected from the group consisting of the first value and the second value.

Another embodiment of the invention provides a method of suppressing dust. The method includes receiving, by a controller, a value from a particulate sensor and a value from a hole depth sensor. The method further comprises adjusting, by the controller, at least one selected from the group consisting of a water flow level of a water injection dust suppression system and a suction level of a dry dust collection system based on at least one selected from the group consisting of the value received from the particulate sensor and the value received from the hole depth sensor.

Another embodiment of the invention provides a method of controlling dust. The method includes automatically detecting an operating status of a mining machine and automatically, with an electronic processor, adjusting operation of a dust suppression system based on the operating status of the mining machine.

Another embodiment of the invention provides a system for controlling dust. The system includes a controller including an electronic processor communicating with non-transitory computer-readable media and an input/output interface. The electronic processor is configured to automatically detect an operating status of a mining machine and automatically adjust operation of a dust suppression system based on the operating status of the mining machine.

Other aspects of the invention will become apparent by consideration of the detailed description and accompanying drawings.

DETAILED DESCRIPTION

Figure 1:
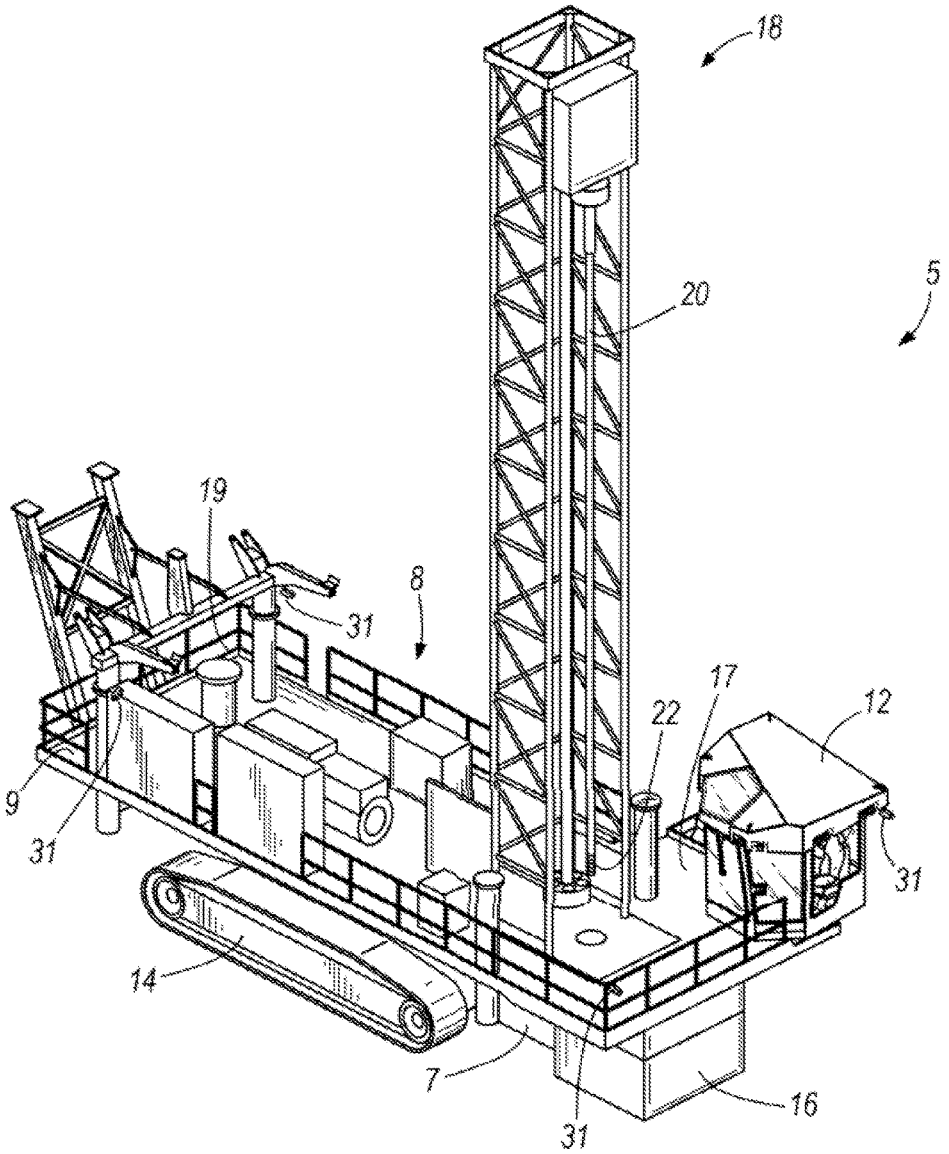
FIG. 1 is a perspective view of a mining machine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more electronic processors. As such, it should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible.

Although the invention described herein can be applied to or used in conjunction with a variety of industrial machines, embodiments of the invention described herein are described with respect to a blasthole drill, such as the blasthole drill 5 shown in FIG. 1. The blasthole drill 5 is used during surface mining operations. The blasthole drill 5 includes a base 7, a body 8 including a machinery deck 9, and an operator's compartment or cab module 12 supported, at least partially, on a portion of the deck 9. In one embodiment, the blasthole drill 5 is movable by drive tracks 14 and, when in an operational position, is supported by at least one supporting structure 16. The blasthole drill 5 defines a first end 17 where a drill mast 18 is located and a second end 19 opposite to the first end 17. In the illustrated construction, the cab module 12 is positioned adjacent to the drill mast 18 near the first end 17 of blasthole drill 5.

The drill mast 18 of the blasthole drill 5 includes a drill steel 20 and a drill bit 22 that are used to drill holes in the ground during the surface mining operation. The drill mast 18 also includes a pulldown/hoist mechanism (not shown) powered by a hydraulic or an electric motor (not shown) that provides turning torque to the pulldown/hoist mechanism through a geared hoist transmission (not shown). During typical operation, the blasthole drill 5 is positioned on the top of a predetermined area. Once the blasthole drill 5 is securely leveled to the ground using leveling controls, the operator operates the steel 20 of the blasthole drill 5 to drill holes in the ground. In one embodiment, on-board cameras 31 are positioned on the blasthole drill 5. The cameras 31 show the area around the blasthole drill 5 and help an operator monitor this area. In some embodiments, an operator is located remotely from the blasthole drill 5.

As described above in the summary section, the blasthole drill 5 creates dust during operation. To maintain visibility for operation, the dust can be suppressed using one or more suppression methods, such as water injection and/or dry dust collection. To provide automatic control of these types of suppression systems, the blasthole drill 5 includes a controller. As described in more detail below, the controller is configured to automatically control dust suppression based on sensed operating statuses (e.g., drilling mode or drilling depth) and environment conditions (e.g., particulate concentration) associated with the blasthole drill 5.

Figure 2:
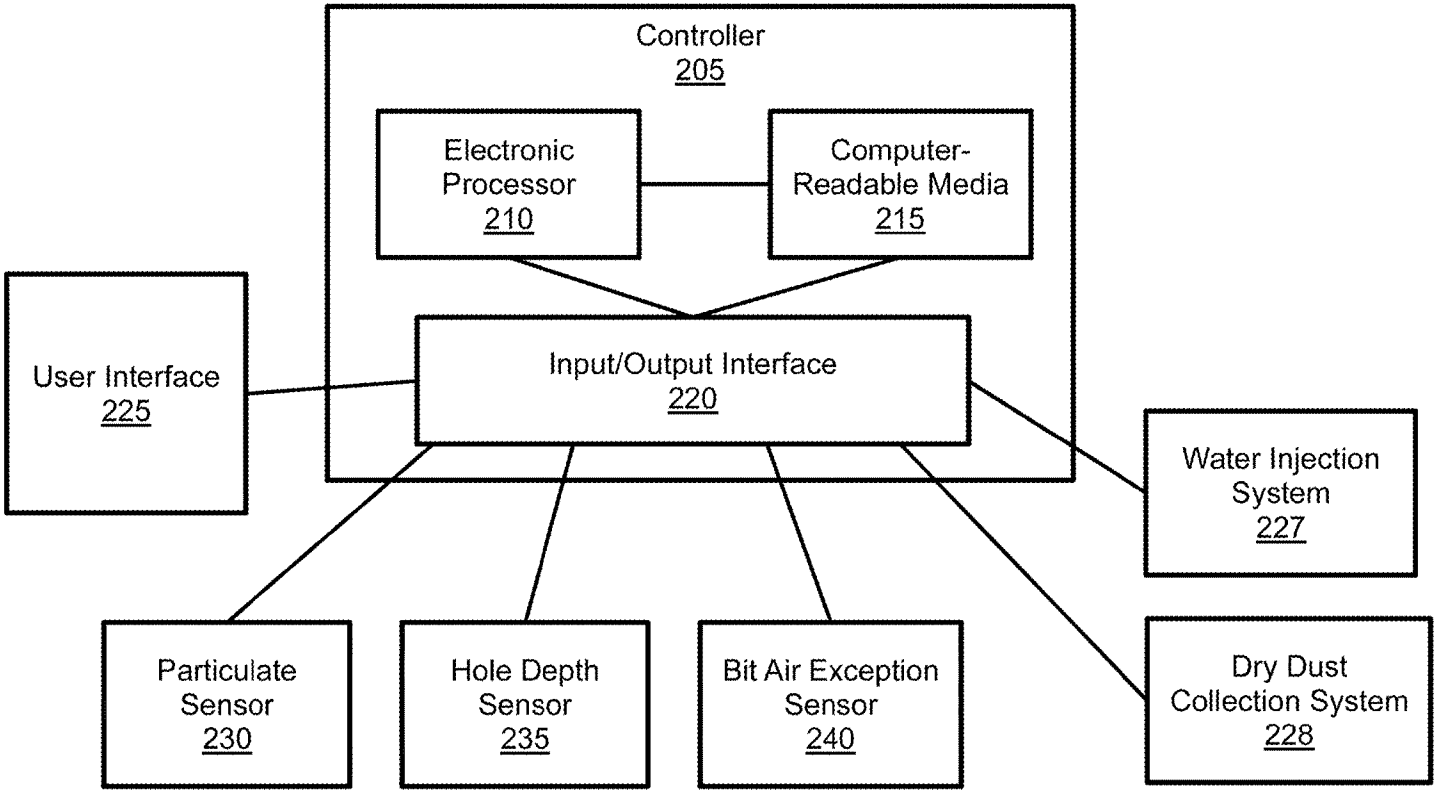
FIG. 2 schematically illustrates a controller for the mining machine of FIG. 1.

FIG. 2 schematically illustrates a controller 205 associated with the blasthole drill 5 according to one embodiment of the invention. It should be understood that the controller 205 can be included in the blasthole drill 5 (e.g., mounted on a component of the blasthole drill 5) or can be a separate component positioned remote from the blasthole drill 5 (e.g., as part of a remote control device or station for the blasthole drill 5).

As illustrated in FIG. 2, the controller 205 includes an electronic processor 210, a non-transitory computer-readable media 215, and an input/output interface 220. The electronic processor 210, the computer-readable media 215, and the input/output interface 220 are connected by one or more control and/or data buses that allow the components to communicate. It should be understood that in other constructions, the controller 205 includes additional, fewer, or different components. Also, it should be understood that the functionality of the controller 205 as described in the present application can be combined with other controllers to perform additional functionality. In addition or alternatively, the functionality of the controller 205 can also be distributed among more than one controller.

The computer-readable media 215 stores program instructions and data. The electronic processor 210 is configured to retrieve instructions from the computer-readable media 215 and execute, among other things, the instructions to perform the control processes and methods described herein. The input/output interface 220 transmits data from the controller 205 to systems, networks, and devices located remotely or onboard the blasthole drill 5 (e.g., over one or more wired and/or wireless connections). The input/output interface 220 also receives data from systems, networks, and devices located remotely or onboard the blasthole drill 5 (e.g., over one or more wired and/or wireless connections). The input/output interface 220 provides received data to the electronic processor 210 and, in some embodiments, can also store received data to the computer-readable media 215.

As illustrated in FIG. 2, the controller 205 communicates with a user interface 225. The user interface 225 allows an operator to move and level the blasthole drill 5 and to operate the drill steel 20. For example, the user interface 225 can include one or more operator-controlled input devices, such as joysticks, levers, foot pedals, and other actuators. The user interface 225 also allows an operator to control dust suppression systems associated with the blasthole drill 5. For example, as described in more detail below, an operator can select an automatic dust suppression override using the user interface 225. Furthermore, the user interface 225 can allow an operator to enter desired settings for dust suppression, such as water flow cutoff depth, suction cutoff depth, and particulate limit, as described below. It should be understood that in some embodiments, the user interface 225 is an integrated component of the controller 205. In other embodiments, the user interface 225 can be separate from the controller 205. In some embodiments, the user interface 225 provides feedback to the user regarding the dust suppression systems. For example, the user interface 225 can display information including a measured water tank level, a measured water flow rate, a water flow rate set point, a dust collector suction output, a dust collector suction set point, a measured particulate level, and/or a particulate level set point. In some embodiments, the user interface 225 provides warnings to the user, such as a water tank low level warning and/or a particulate sensor failure warning.

The controller 205 also communicates with other devices on the blasthole drill 5 to control dust suppression systems, such as controlling water flow level and suction level. For example, the controller 205 can send control signals to a water injection system 227 to control the amount of water used by the system 227. Similarly, the controller 205 can send a control signal to a dry dust collection system 228 to control the level or amount of suction used by the system 228. In some embodiments, the controller 205 also communicates with these systems 227 and 228 to receive status or operating information, such as a current water flow and/or a current suction rate being applied by the systems 227 and 228.

The controller 205 also communicates with and receives information from one or more sensors associated with the blasthole drill 5. The sensor(s) monitor various conditions of the drilling process and drilling environment to detect an operating status of the blasthole drill 5 and/or an environment condition. For example, in some embodiments, the controller 205 communicates with a particulate sensor 230, a hole depth sensor 235, and/or a bit air exception sensor 240. The particulate sensor 230 measures the amount of airborne dust and particulates in the drilling environment ("dust particulate concentration"). In some embodiments, the particulate sensor 230 is a harsh environment rated particulate sensor and transmitter that uses conductance to measure the amount of particulates in an area surrounding a probe. In some embodiments, the particulate sensor 230 is placed above the first end 17 of the deck 9 in between the cab module 12 and the drill steel 20. The hole depth sensor 235 measures the depth of the hole being drilled by the blasthole drill 5 ("drilling depth"). The bit air exception sensor 240 indicates when it is necessary to retract the drill bit to clear a blockage in the hole.

Figure 3:
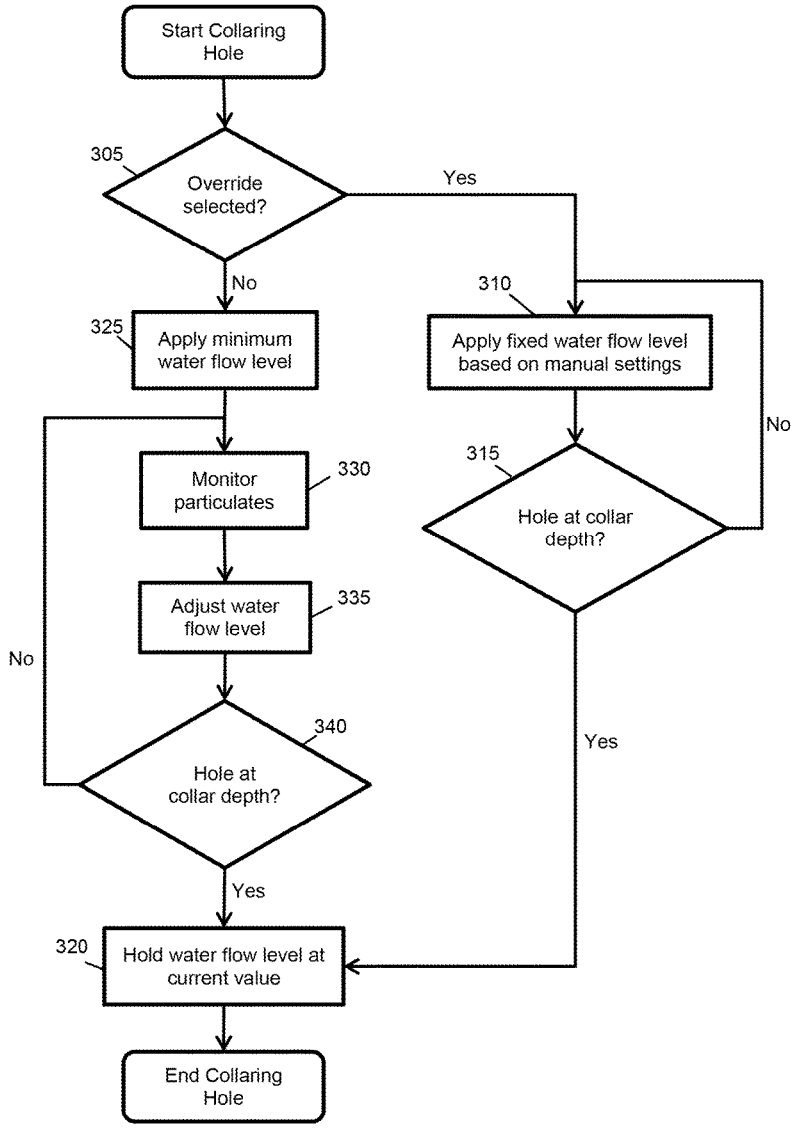
FIG. 3 is a flowchart illustrating a method of controlling water injection dust suppression when a mining machine is in a collaring mode.

As noted above, the electronic processor 210 is configured to retrieve instructions from the computer-readable media 215 and execute, among other things, the instructions to perform control processes and methods for the blasthole drill 5. For example, FIG. 3 is a flow chart illustrating a method of controlling water injection dust suppression when the blasthole drill 5 is in a collaring mode performed by the controller 205 (i.e., the electronic processor 210). The blasthole drill 5 is in the collaring mode when drilling the first several feet of each hole. In some embodiments, the controller 205 determines that the blasthole drill 5 is in collaring mode based on the status of the blasthole drill 5 and information received from the hole depth sensor 235. For example, when the blasthole drill 5 is drilling and the hole depth is less than the predetermined collar depth, the blasthole drill 5 is in collaring mode. In some embodiments, the predetermined collar depth is set by the user (e.g., through the user interface 225). In other embodiments, the predetermined collar depth is loaded into the controller 205 automatically with an imported hole pattern.

As illustrated in FIG. 3, the controller 205 determines whether the automatic dust suppression override (e.g., manual dust suppression) has been selected by the operator (at block 305) (e.g., through the user interface 225). If the automatic dust suppression override has been selected, the controller 205 applies a fixed water flow level for water injection (at block 310). The fixed water flow level can be a default value or a value manually set by the operator (e.g., through the user interface 225). The controller 205 applies the fixed water flow level until the depth of the hole reaches the desired collaring depth (i.e., based on data received from the hole depth sensor 235) (at block 315) or until the fixed water flow level is manually adjusted by the operator. When the depth of the hole reaches the desired collaring depth (at block 315), the controller 205 holds the water flow level its current value (at block 320).

Alternatively, if the automatic dust suppression override has not been selected (at block 305), the controller 205 performs automatic dust suppression to control the water flow level during the collaring process. In particular, as illustrated in FIG. 3, the controller 205 is configured to automatically apply a minimum water flow level for water injection (at block 325) when collaring begins.

During collaring of the hole, the controller 205 also monitors particulates in the air of the drilling environment using the particulate sensor 230 (at block 330) and automatically adjusts the water flow level based on the amount of particulates (at block 335). For example, the controller 205 can increase or decrease the water flow level based on values sensed by the particulate sensor 230 according to program instructions and data stored on the computer-readable media 215. In some embodiments, the controller 205 uses a proportional-integral ("PI") control loop to modulate the water flow level based on loop parameters. The loop parameters can include a minimum and maximum output water flow level and a proportional factor and integral component that determine how quickly the loop responds to changes in the sensed particulate level. In some embodiments, if the controller 205 determines that the water flow level should be increased based on the sensed particulate level and the current water flow level is at the maximum output water flow level, the controller 205 does not increase the water flow level. However, in these situations, the controller 205 can generate a warning (e.g., informing an operator of a potential failure after a specified period of time if there is no reduction in particulates). In some embodiments, the particulate sensor 230 is associated with measurable bounds for particulates. Therefore, the controller 205 can be configured to assume that a measured particulate level is valid as long as it is within the measurable bounds of the sensor 230. In other embodiments, however, the controller 205 can compare measured particulate levels to specific bounds unrelated to the limits of the sensor 230 (e.g., bounds set by an operator through the user interface 225). If a measured particulate level is not within specified bounds (e.g., set by the operator or associated with the sensor 230), the automatic dust suppression functionality provided by the controller 205 can be disabled (e.g., allowing adjustment of the water flow level only through manual control).

The controller 205 can also monitor the depth of the hole being drilled based on data received from the hole depth sensor 235 (at block 340). If the hole is not at the desired collar depth, the controller 205 continues to monitor the particulates in the air using the particulate sensor 230 (at block 330) and adjust the water flow level accordingly (at block 335). When the hole reaches the desired collar depth, controller 205 holds the water flow level at its current value (at 320).

Figure 4:
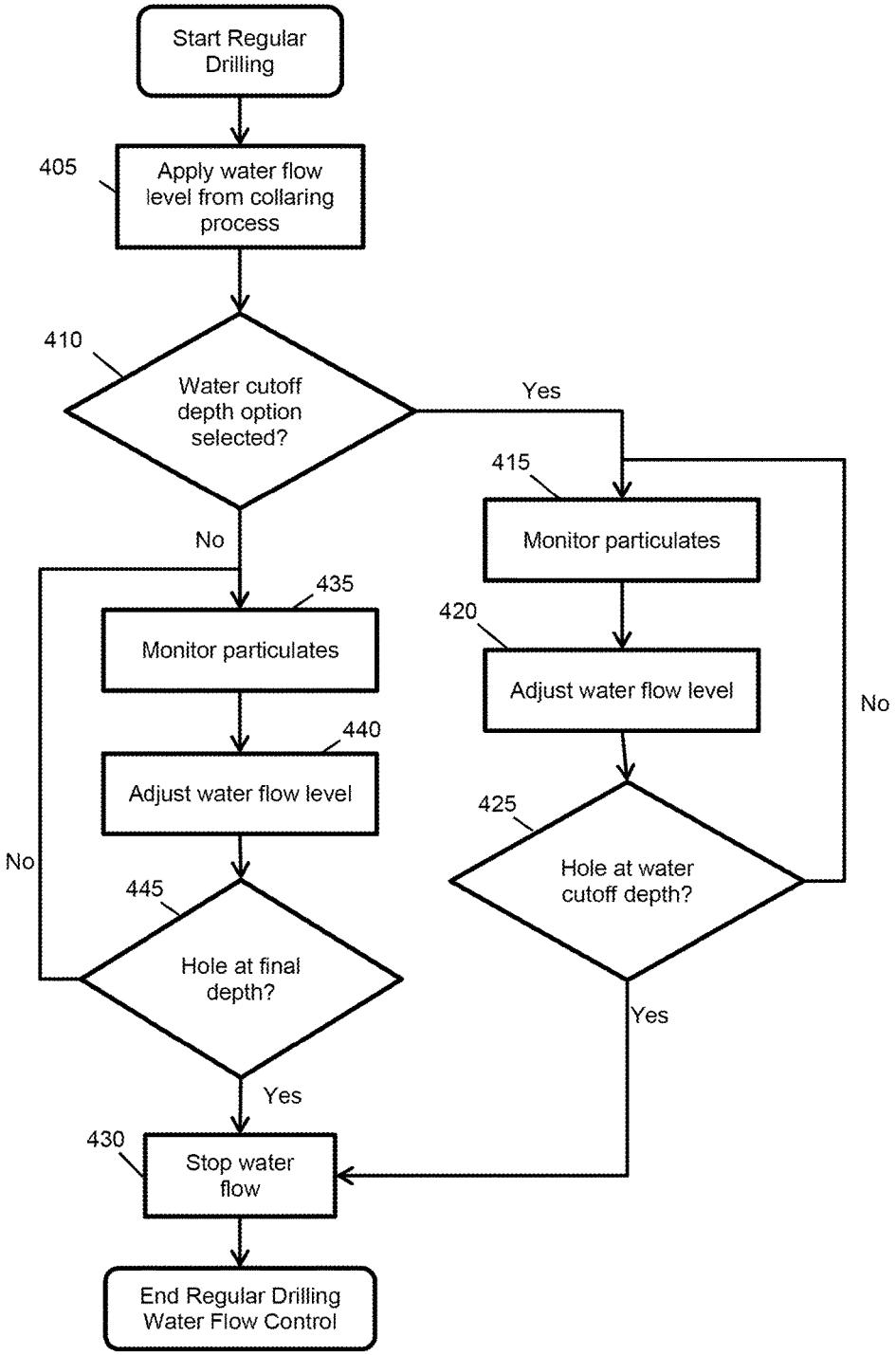
FIG. 4 is a flowchart illustrating a method of controlling water injection dust suppression when a mining machine is in a drilling mode.

After the collaring process is complete, the blasthole drill 5 enters a regular drilling mode to drill the remainder of the hole. FIG. 4 is a flowchart illustrating a method of controlling water injection dust suppression when the blasthole drill 5 is in the regular drilling mode performed by the controller 205 (i.e., the electronic processor 210). As illustrated in FIG. 4, the controller 205 initially maintains the water flow level that was most recently used in the collaring process (at block 405). The controller 205 also determines if a water cutoff depth option has been selected by the operator (at block 410) (e.g., through the user interface 225). The water cutoff depth can represent a drilling depth greater than a collaring depth and less than the final drill depth of the hole. If the water cutoff depth option has been selected, the controller 205 monitors particulates in the air of the drilling environment using data from the particulate sensor 230 (at block 415) and automatically adjusts the water flow level based on the amount of particulates (at block 420). In some embodiments, the controller 205 uses a PI loop as described above to adjust the water flow level based on the amount of particulates.

The controller 205 continues this monitoring and adjusting (at blocks 415 and 420) until the depth of the hole reaches the operator-selected desired water cutoff depth (i.e., based on data from the hole depth sensor 235) (at block 425). The desired water flow cutoff depth may be at the bottom of the hole or a distance short (e.g., one or several feet) of the bottom of the hole based on operator preference and/or environment conditions. When the depth of the hole reaches the desired water cutoff depth (at 425), the controller 205 automatically stops the water flow (at block 430).

Alternatively, if the operator has not selected the water cutoff depth option, the controller 205 monitors particulates in the air of the drilling environment using the particulate sensor 230 (at block 435) and automatically adjusts the water flow level based on the amount of particulates (at block 440) until the final drill depth is reached (at block 445). When the hole reaches a final depth (at block 445), the controller 205 stops the drilling and automatically stops the water flow (at block 430). It should be understood that, in some embodiments, the controller 205 allows an operator to override automatic control of the water injection system during regular drilling similar to the manual override for the water injection system during the collaring process described above with respect to FIG. 3.

Alternatively or in addition to controlling the water flow of the water injection dust suppression method, the controller 205 controls a dry dust collection system. For example, the controller 205 can be configured to adjust a suction level of a vacuum pump using similar methods as illustrated in FIGS. 3 and 4. In particular, FIGS. 5 and 6 illustrate methods of controlling the suction level of a vacuum pump used during dry dust collection performed by the controller 205 (i.e., the electronic processor 210).

Figure 5:
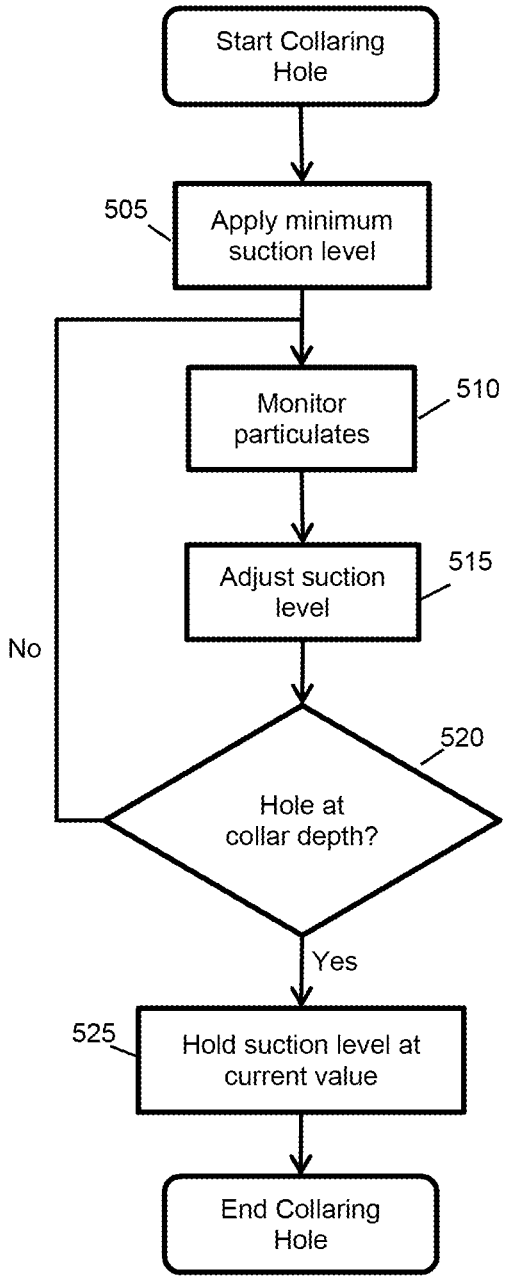
FIG. 5 is a flowchart illustrating a method of controlling dry dust collection when a mining machine is in a collaring mode.
Figure 6:
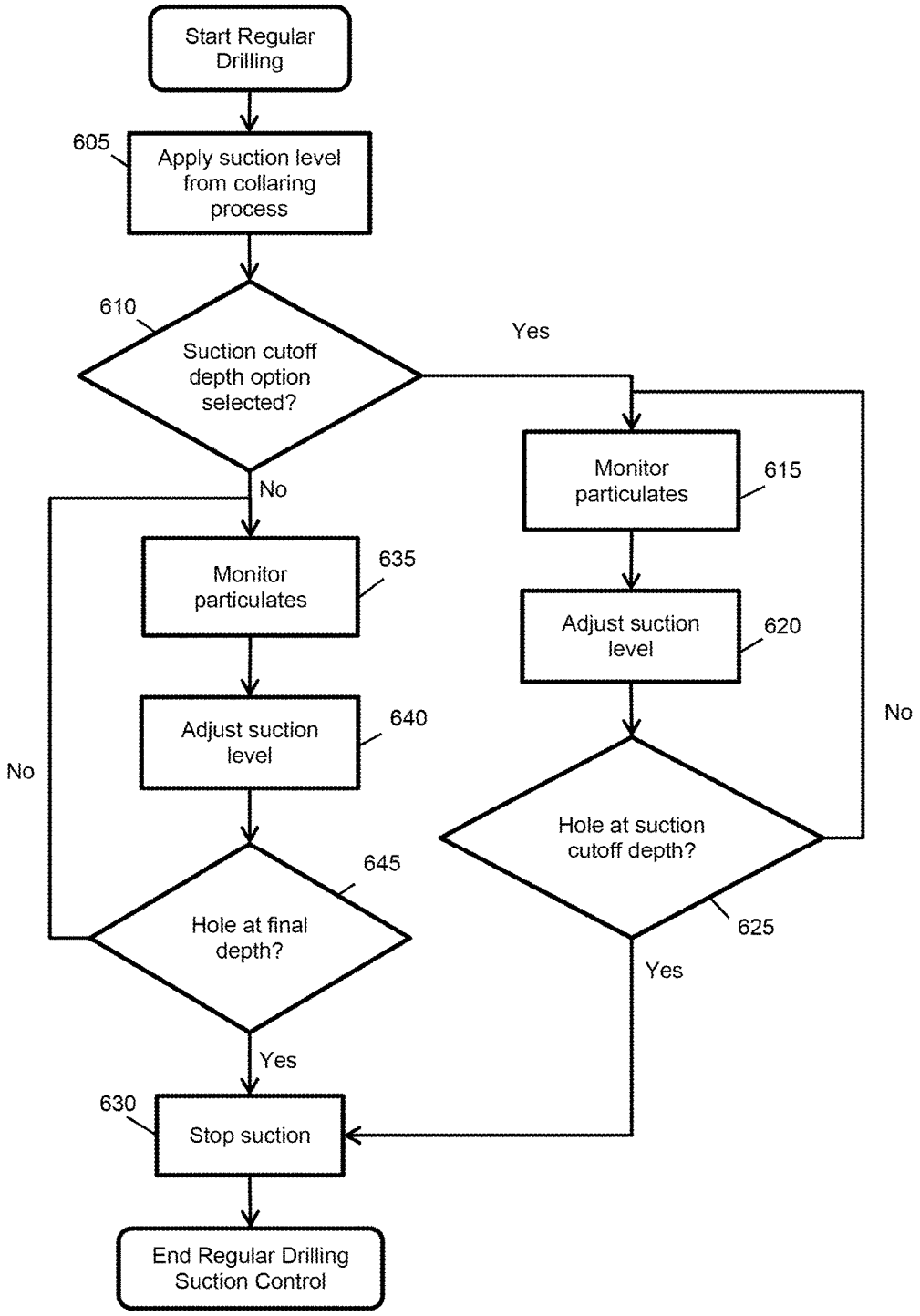
FIG. 6 is a flowchart illustrating a method of controlling dry dust collection when a mining machine is in a drilling mode.

FIG. 5 is a flow chart illustrating a method of controlling a suction level of a vacuum pump included in a dry dust collection system when the blasthole drill 5 is in the collaring mode. As illustrated in FIG. 5, when collaring of a hole begins, the controller 205 is configured to automatically turn on a vacuum pump and run the pump at a minimum suction level (at block 505). During collaring of the hole, the controller 205 monitors particulates in the air of the drilling environment using the particulate sensor 230 (at block 510) and automatically adjusts the suction level of the vacuum pump based on the amount of particulates (at block 515). For example, the controller 205 can be configured to increase or decrease the suction level based on values sensed by the particulate sensor 23 according to program instructions and data stored on the computer-readable media 215. In some embodiments, the controller 205 uses a PI loop as described above to control a suction level based on a sensed particulate level.

As illustrated in FIG. 5, the controller 205 also monitors a depth of the hole being drilled using the hole depth sensor 235 (at block 520). If the hole is not at the desired collar depth, the controller 205 continues to monitor the air in the drilling environment (at block 510) and automatically adjust the suction level accordingly (at block 515). When the hole reaches the desired collar depth, the controller 205 holds the suction level at its current value (at block 525).

After the collaring process is complete, the blasthole drill 5 enters the regular drilling mode to drill the remainder of the hole. FIG. 6 is a flowchart illustrating a method of controlling a suction level of a vacuum pump included in a dry dust collection system when the blasthole drill 5 is in the regular drilling mode. As illustrated in FIG. 6, during the regular drilling mode, the controller 205 initially maintains the suction level that was most recently used in the collaring process (at block 605). The controller 205 then determines if a suction cutoff depth option has been selected by the operator (at block 610). Similar to the water cutoff depth described above, the suction cutoff depth can represent a depth of the hole greater than the collaring depth but less than the final depth of the hole.

If the suction cutoff depth option has been selected, the controller 205 monitors particulates in the air of the drilling environment using the particulate sensor 230 (at block 615) and automatically adjusts the suction level based on the amount of particulates (at block 620). In some embodiments, the controller 205 uses a PI loop as described above to adjust the suction level based on the amount of particulates.

The controller 205 continues monitoring particulates (at block 615) and automatically adjusting the suction level (at block 620) until the depth of the hole reaches the desired suction cutoff depth (i.e., based on data from the hole depth sensor) (at block 625). As noted above with respect to the water cutoff depth, the desired suction cutoff depth may be at the bottom of the hole or a distance (e.g., several feet) short of the bottom of the hole based on operator preference and/or environment conditions. When the depth of the hole reaches the desired suction cutoff depth (at block 625), the controller 205 automatically turns off the vacuum pump to stop suction (at block 630).

Alternatively, if the suction cutoff depth option has not been selected by the operator, the controller 205 monitors particulates in the air of the drilling environment using the particulate sensor 230 (at block 635) and automatically adjusts the suction level accordingly (at block 640) as described above until the final drill depth is reached (at block 645). When the hole reaches the desired final depth (i.e., based on data from the hole depth sensor 235) and drilling has stopped, the controller 205 automatically turns off the vacuum pump to stop suction (at block 630). It should be understood that, in some embodiments, the controller 205 allows an operator to override automatic control of the dust suppression system (e.g., during the collaring process and/or the regular drilling process) similar to the manual override for the water injection system described above with respect to FIG. 3.

In should be understood that the controller 205 can be configured to apply different options for controlling water flow and/or suction level during the dust suppression methods of FIGS. 3-6. For example, the controller 205 can be configured to automatically turn off one or more dust suppression systems (e.g., the water injection system and/or the dry dust collection system) when a specified cutoff depth of the hole is reached (i.e., at blocks 425 and/or 625). Alternatively, the controller 205 can be configured to automatically turn off one or more dust suppression systems when a hole is at a desired final depth or when drilling has stopped (i.e., at blocks 445 and/or 645). Also, in some embodiments, the controller 205 can be configured to automatically turn off one or more dust suppression systems when the controller 205 stops the drilling and automatically turn back on one or more dust suppression systems when the controller 205 starts the drilling again. For example, when a bit air exception is detected by the bit air exception sensor 240, drilling may be stopped to clear a blockage. If drilling is stopped, the controller 205 can be configured to automatically stop one or more dust suppression systems until the blockage is cleared. After the blockage is cleared and drilling restarts, the controller 205 can automatically turn one or more suppression systems back on. It should be understood that the dust suppression systems can be automatically turned on or off regardless of whether water flow level and suction level are controlled manually or adjusted automatically.

In some embodiments, the controller 205 is configured to adjust the water flow level and/or the suction level to maintain a particulate limit (e.g., keep a particulate concentration level at or below a predetermined threshold). Accordingly, the controller 205 uses data from the particulate sensor 230 as feedback to determine whether the particulate limit has been exceeded. For example, in some embodiments, a proportional-integral-derivative (PID) loop is used to maintain the desired particulate limit. The particulate limit can be set by the operator (e.g., through the user interface 225) or, alternatively, can be preprogrammed in the computer-readable media 215. In some embodiments, the particulate limit is the same during the collaring mode as during the regular drilling mode. In other embodiments, the particulate limit is different during the collaring mode than during the regular drilling mode and may be different based on the type of dust suppression system being used.

It should also be understood that during drilling, the controller 205 can automatically adjust the water flow level and the suction level independently of each other or in tandem with each other. For example, in some embodiments, the controller 205 is configured to consider the operation any other dust suppression systems as part of automatically adjusting a particular dust suppression system (e.g., consider what water level is being applied by the water injection system when automatically setting the suction level of the dry dust collection system).

In addition, it should be understood that the controller 205 can be configured to allow a user to control one or multiple dust suppression systems manually (e.g., using an override as specified above) during one or more drilling processes (e.g., a collaring process and/or a regular drilling process) while the controller 205 controls one or more dust suppression systems automatically. The manual or automatic control of each system can be set by a user through the user interface 225. Also, it should be understood that in some embodiments, the blasthole drill 5 only has one dust suppression system that can be operated manually or automatically. For example, the blasthole drill 5 may only be operated with a water injection system or a dry dust collection system.

As noted above, in some embodiments, the controller 205 is configured to control water flow level and/or suction level based on a current drilling mode. For example, blocks 405 and 605 apply the water flow level and suction level, respectively, that was held when the collaring process ended. However, it should be understood that in some embodiments, the controller 205 adjusts water flow level and/or suction level when the blasthole drill 5 switches modes (e.g., from a collaring mode to a regular drilling mode).

It should also be understood that the override options described above are optional and may not be available to an operator in all embodiments of the invention or during particular modes or drilling conditions or environments. For example, in some embodiments, if the amount of particulates in the air reaches a predetermined limit, the controller 205 may be configured to prevent an operator from selecting a manual override.

Thus, embodiments of the invention provide, among other things, automatic dust suppression for machinery, such as a blasthole drill or other mining machinery. A controller (included in the machinery or located remote from the machinery) can monitor operating parameters such as particulate level, drilling mode, and hole depth to automatically control at least one dust suppression system associated with the machinery. The automatic control can include automatically turning a suppression system on or off and/or setting a level of operation of a suppression system (e.g., water flow and/or suction level).

What is claimed is:

1. A method of controlling dust, the method comprising:

automatically detecting an operating status of a mining machine; and automatically, with an electronic processor, adjusting operation of a dust suppression system based on the operating status of the mining machine, wherein the electronic processor adjusts the operation of the dust suppression system by setting a first operating level for the dust suppression system from a plurality of operating levels in response to the mining machine drilling at a first depth and by setting a second operating level for the dust suppression system from the plurality of operating levels in response to the mining machine drilling at a second depth.

2. The method of claim 1, further comprising automatically detecting an environment condition.

3. The method of claim 2, wherein automatically adjusting the operation of the dust suppression system includes automatically adjusting the operation of the dust suppression system based on the operating status of the mining machine and the environment condition.

4. The method of claim 3, wherein automatically detecting the environment condition includes automatically detecting a dust particulate concentration.

5. The method of claim 1, wherein automatically detecting the operating status of the mining machine includes automatically detecting a drilling mode of the mining machine.

6. The method of claim 1, wherein automatically detecting the operating status of the mining machine includes automatically detecting a drilling depth of the mining machine.

7. The method of claim 1, wherein automatically adjusting the operation of the dust suppression system includes automatically adjusting the operation of a water injection system.

8. The method of claim 7, wherein automatically adjusting the operation of the water injection system includes automatically adjusting a water flow level of the water injection system.

9. The method of claim 1, wherein automatically adjusting the operation of the dust suppression system includes automatically adjusting the operation of a dry dust collection system.

10. The method of claim 1, wherein automatically adjusting the operation of the dust suppression system includes automatically adjusting a suction level of a dry dust collection system.

11. The method of claim 1, wherein automatically detecting the operating status of the mining machine includes receiving information from a hole depth sensor.

12. The method of claim 1, wherein automatically detecting the operating status of the mining machine includes receiving information from a bit air exception sensor.

13. The method of claim 2, wherein automatically detecting the environment condition includes receiving information from a particulate sensor.

14. A system for controlling dust, the system comprising:

a controller including an electronic processor communicating with non-transitory computer-readable media and an input/output interface, wherein the electronic processor is configured to:

automatically detect an operating status of a mining machine, and automatically adjust operation of a dust suppression system based on the operating status of the mining machine, wherein the electronic processor adjusts the operation of the dust suppression system by setting a first operating level for the dust suppression system from a plurality of operating levels in response to the mining machine drilling at a first depth and by setting a second operating level for the dust suppression system from the plurality of operating levels in response to the mining machine drilling at a second depth.

15. The system of claim 14, wherein the electronic processor is further configured to automatically detect an environment condition.

16. The system of claim 15, wherein the electronic processor is configured to automatically adjust the operation of the dust suppression system by automatically adjusting the operation of the dust suppression system based on the operating status of the mining machine and the environment condition.

17. The system of claim 16, wherein the electronic processor is configured to automatically detect the environment condition by automatically detecting a dust particulate concentration.

18. The system of claim 14, wherein the electronic processor is configured to automatically detect the operating status of the mining machine by automatically detecting a drilling mode of the mining machine.

19. The system of claim 14, wherein the electronic processor is configured to automatically detect the operating status of the mining machine by automatically detecting a drilling depth of the mining machine.

20. The system of claim 14, wherein the dust suppression system includes a water injection system.

21. The system of claim 20, wherein the electronic processor is configured to automatically adjust the operation of the water injection system by automatically adjusting a water flow level of the water injection system.

22. The system of claim 14, wherein the dust suppression system includes a dry dust collection system.

23. The system of claim 22, wherein the electronic processor is configured to automatically adjust the operation of the dust suppression system by automatically adjusting a suction level of the dry dust collection system.

24. The system of claim 14, wherein the electronic processor is configured to automatically detect the operating status of the mining machine based on information received from a hole depth sensor through the input/output interface.

25. The system of claim 14, wherein the electronic processor is configured to automatically detect the operating status of the mining machine based on information received from a bit air exception sensor through the input/output interface.

26. The system of claim 15, wherein the electronic processor is configured to automatically detect the environment condition based on information received from a particulate sensor through the input/output interface.

* * * * *